US010556769B2

(12) United States Patent
Weissbrod

(10) Patent No.: US 10,556,769 B2
(45) Date of Patent: Feb. 11, 2020

(54) STORAGE DEVICE FOR SPOOLED WIRE

(71) Applicant: Lincoln Global, Inc., Santa Fe Springs, CA (US)

(72) Inventor: Paul A. Weissbrod, South Euclid, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 8 days.

(21) Appl. No.: 15/969,047

(22) Filed: May 2, 2018

(65) Prior Publication Data

US 2018/0362287 A1 Dec. 20, 2018

Related U.S. Application Data

(60) Provisional application No. 62/520,819, filed on Jun. 16, 2017.

(51) Int. Cl.
*B65H 49/38* (2006.01)
*B65H 55/00* (2006.01)

(52) U.S. Cl.
CPC ..... *B65H 49/38* (2013.01); *B65H 55/00* (2013.01); *B65H 2701/36* (2013.01)

(58) Field of Classification Search
CPC .... B65D 85/67; B65D 85/671; B65D 85/672; B65D 85/04; B65H 49/38; B65H 55/00; B65H 75/02; B65H 75/141; B65H 2701/36; H01L 21/60
See application file for complete search history.

(56) References Cited

U.S. PATENT DOCUMENTS 464,230 A 12/1891 Robbins
564,153 A 7/1896 Knight
(Continued)

FOREIGN PATENT DOCUMENTS

CN 2321300 Y 6/1999
DE 41 36 268 C2 10/1996
(Continued)

OTHER PUBLICATIONS

Fsindustries; "Cabinets With Hook on Bins"; http://www.fsindustries.com/more_info/cabinets_with_hook_on_bins_ssc/cabinets_with_hook_on_bins_ssc.shtml; Dated Mar. 27, 2018; pp. 1-3.
(Continued)

*Primary Examiner* — Bryon P Gehman
(74) *Attorney, Agent, or Firm* — Brad C. Spencer

(57) ABSTRACT

A spool wire storage device includes a cabinet body, a door for providing access to an interior of the cabinet body, and a plurality of U-shaped spooled wire storage trays mounted within the cabinet body. The U-shaped spooled wire storage trays include a U-shaped bottom shelf, and a U-shaped sidewall extending upward from the U-shaped bottom shelf. The U-shaped bottom shelf and the U-shaped sidewall form an open front portion of the storage tray extending between terminal ends of the U-shaped sidewall. The U-shaped bottom shelf declines from the open front portion rearward. A spool of wire is located in each of the plurality of U-shaped spooled wire storage trays. A base is located beneath the cabinet body. The base forms a first fork channel and a second fork channel configured to receive forklift forks.

20 Claims, 7 Drawing Sheets

(56) References Cited

U.S. PATENT DOCUMENTS

| | | | | | |
|---|---|---|---|---|---|
| 4,129,216 | A * | 12/1978 | Schick | A47F 7/17 211/85.5 |
| 5,819,937 | A * | 10/1998 | Walker | A47B 73/00 206/429 |
| 7,431,156 | B2 | 10/2008 | Carlsson | |
| 7,798,180 | B2 | 9/2010 | Kazuaki et al. | |
| 2003/0098253 | A1 | 5/2003 | You et al. | |
| 2017/0355499 | A1 | 12/2017 | Cheng | |

FOREIGN PATENT DOCUMENTS

| | | | | |
|---|---|---|---|---|
| JP | 2001210670 | A * | 8/2001 | B65H 75/141 |
| JP | 3858816 | B2 | 12/2006 | |
| WO | 2017/055560 | A1 | 4/2017 | |

OTHER PUBLICATIONS

Corstat; "Reel Storage System"; http://www.farnell.com/datasheets/5528.pdf; Accessed on Mar. 29, 2018; pp. 1-2.

Keen; "KT-54NH TIG Filler Rod Unheated Storage Cabinet"; https://www.rodovens.com/index.php/keen-kt-54nh-tig-filler-rod-unheated-storage-cabinet-made-in-usa.html; Accessed on Mar. 29, 2018; pp. 1-2.

Commander Warehouse Equipment Ltd.; "Hi Density Security Bin Cabinet"; https://www.commander.ca/product-hi-density-security-bin-cabinet/; Accessed on Mar. 29, 2018; pp. 1-2.

* cited by examiner

STORAGE DEVICE FOR SPOOLED WIRE

CROSS-REFERENCE TO RELATED APPLICATIONS

Benefit of U.S. Provisional Patent Application Ser. No. 62/520,819 filed Jun. 16, 2017 is hereby claimed and the disclosure incorporated herein by reference.

BACKGROUND OF THE INVENTION

Field of the Invention

The present invention relates to a combined shipping and storage device for spooled wire, such as welding wire.

Description of Related Art

Individual spools of welding wire, which may be cored wire or solid wire, are typically packaged and shipped in cardboard boxes containing one spool of wire each. Spooled welding wire may also be shipped in multi-spool boxes, containing two or four spools per box, for example. Common spool diameter sizes include 4 inch spools, 8 inch spools, 12 in spools, and 16 inch spools, and the spools are typically made of plastic. Within the box, the spool of welding wire may further be sealed within a plastic or foil pouch or bag and/or capsule sealed by a form fitting plastic wrapping, to limit the exposure of the welding wire to humidity and other environmental contaminants.

A number of individually-boxed spools of welding wire can be shipped together to a customer. The boxes can be placed on a pallet so that they may be moved together by a forklift. The boxes are stacked on the pallet, and secured together and to the pallet, using strapping bands and stretch wrap for example. A common shipping configuration includes placing the boxes onto the pallet in layers of 9 boxes (3×3 array), up to a desired height (e.g., 5 boxes high, 6 boxes high, 7 boxes high, etc.). Thus, a pallet having layers of 9 boxes stacked 5 boxes high will support 45 boxes of welding wire for shipment.

For inventory control and quality control purposes, a customer receiving palletized welding wire may wish to inspect individual spools, and possibly every spool received. This is a very labor-intensive process and can require removal of the strapping and stretch wrap from the pallet, opening each cardboard box, opening (cutting, tearing, etc.) the plastic or foil bag, inspecting and possibly labeling the spool with inventory control information, and resealing the spool within the plastic or foil bag. The individual spools will then be taken to an appropriate storage area for later use.

A shipping device that allows for customer inspection and storage of individual spools of wire with reduced labor and material waste would be beneficial.

BRIEF SUMMARY OF THE INVENTION

The following summary presents a simplified summary in order to provide a basic understanding of some aspects of the devices, systems and/or methods discussed herein. This summary is not an extensive overview of the devices, systems and/or methods discussed herein. It is not intended to identify critical elements or to delineate the scope of such devices, systems and/or methods. Its sole purpose is to present some concepts in a simplified form as a prelude to the more detailed description that is presented later.

In accordance with one aspect of the present invention, provided is a spooled wire storage tray. The spooled wire storage tray comprises a U-shaped bottom shelf, a U-shaped sidewall extending upward from the U-shaped bottom shelf, an outwardly projecting lip atop the U-shaped sidewall, a first resilient spool retaining bulge located along the U-shaped sidewall, and a second resilient spool retaining bulge located along the U-shaped sidewall opposite the first resilient spool retaining bulge. The U-shaped bottom shelf and the U-shaped sidewall form an open front portion of the storage tray extending between terminal ends of the U-shaped sidewall. The U-shaped bottom shelf forms an open central portion of the storage tray that extends inward from the open front portion of the storage tray, allowing access to a lower spool flange through the U-shaped bottom shelf.

In accordance with a further aspect of the present invention, provided is a spooled wire storage tray. The spooled wire storage tray comprises a U-shaped bottom shelf, a U-shaped sidewall extending upward from the U-shaped bottom shelf, an outwardly projecting lip atop the U-shaped sidewall, a plurality of buttresses located on the U-shaped sidewall, and a plurality of mounting tabs extending outward from at least one of the U-shaped sidewall and the outwardly projecting lip. The U-shaped bottom shelf and the U-shaped sidewall form an open front portion of the storage tray extending between terminal ends of the U-shaped sidewall. The U-shaped bottom shelf forms an open central portion of the storage tray that extends inward from the open front portion of the storage tray, allowing access to a lower spool flange through the U-shaped bottom shelf.

In accordance with a further aspect of the present invention, provided is a spool wire storage device that includes a cabinet body, a door for providing access to an interior of the cabinet body, and a plurality of U-shaped spooled wire storage trays mounted within the cabinet body. The U-shaped spooled wire storage trays include a U-shaped bottom shelf, and a U-shaped sidewall extending upward from the U-shaped bottom shelf. The U-shaped bottom shelf and the U-shaped sidewall form an open front portion of the storage tray extending between terminal ends of the U-shaped sidewall. The U-shaped bottom shelf declines from the open front portion rearward. A spool of wire is located in each of the plurality of U-shaped spooled wire storage trays. A base is located beneath the cabinet body. The base forms a first fork channel and a second fork channel configured to receive forklift forks.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
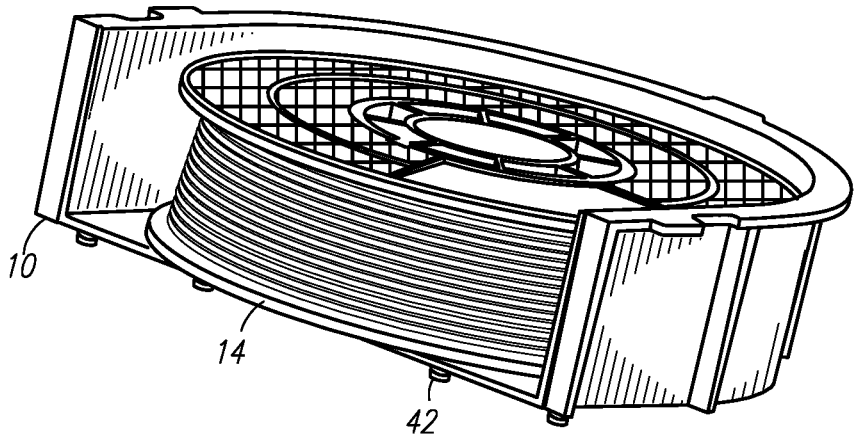
FIG. 1 is a perspective view of a spool and storage tray.
Figure 2:
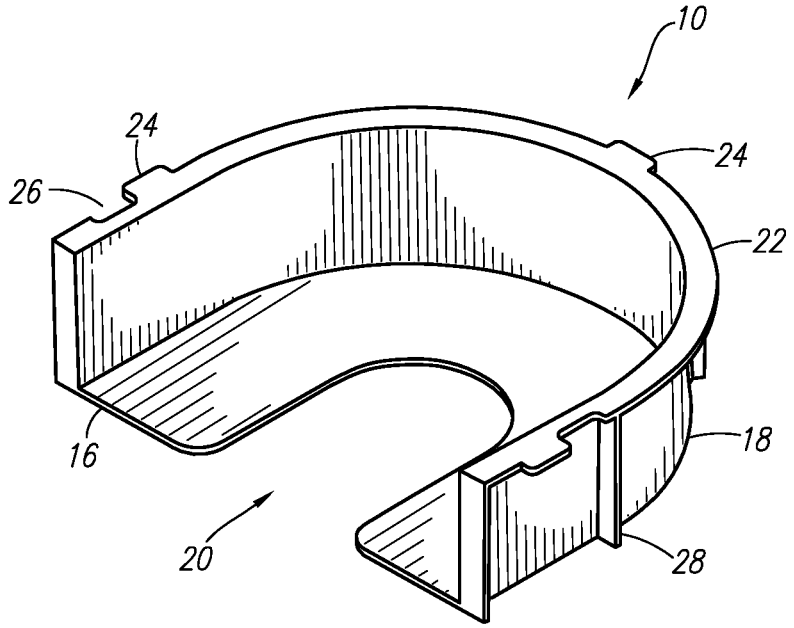
FIG. 2 is a perspective view a storage tray.
Figure 3:
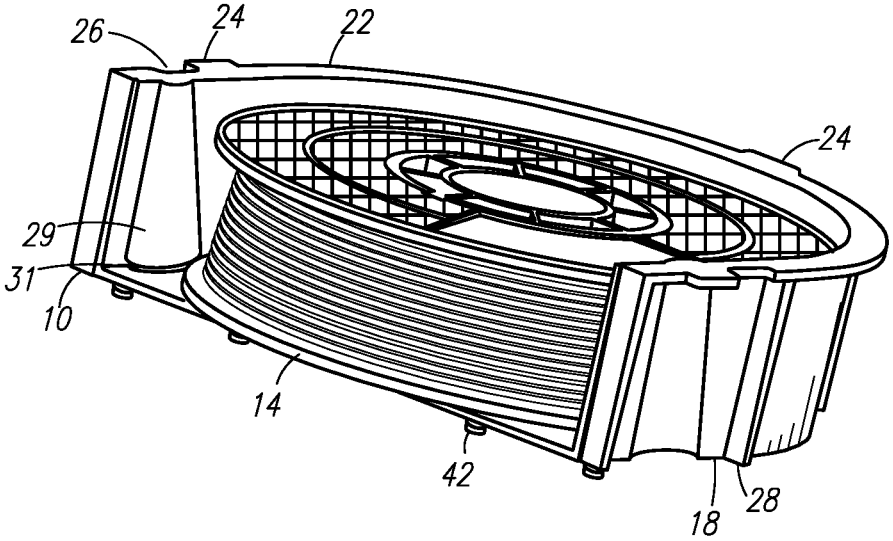
FIG. 3 is a perspective view of a spool and storage tray.
Figure 4:
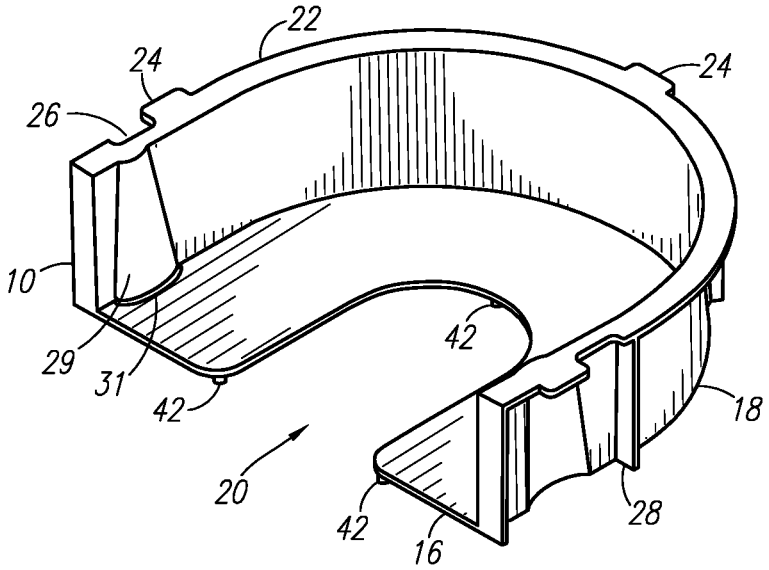
FIG. 4 is a perspective view a storage tray.
Figure 5:
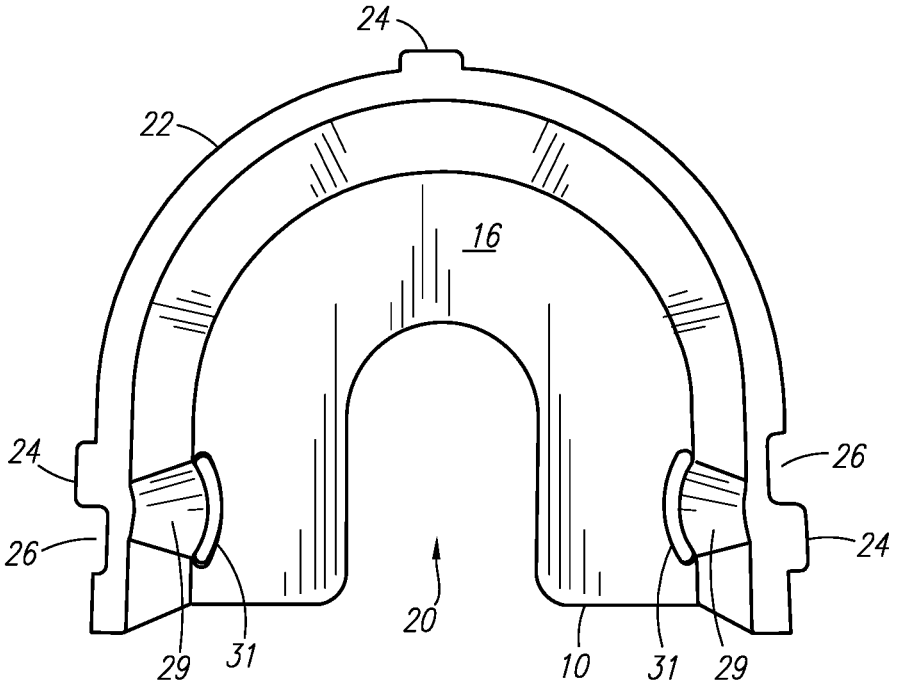
FIG. 5 is a top view of a storage tray.

The present invention relates to a combined shipping and storage device for spooled wire, such as welding wire. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

With reference to FIGS. 1, 2, 8 and 9, disclosed is a tray 10 and cabinet 12 for both shipping and storing individual spools of wire, such as welding wire, without boxing the individual spools. That is, the spools are stored in the trays 10 in an unboxed condition. Because the spools are shipped without a box, inspection and inventory control at the shipping destination (hereinafter "customer") can be completed more quickly and with less material waste as compared to the conventional shipping method discussed above. Further, the cabinet 12 can be used as both a shipping container and by the customer as a storage cabinet at the customer's facility after the spools are received. The cabinet can also be reused repeatedly as both a shipping container and storage cabinet for subsequent shipments of spooled wire.

The tray 10 supports a spool 14 of wire. The spool 14 can be enclosed in a pouch or bag (not shown) and/or partially enclosed by a capsule seal around the circumference of the spool, to limit the exposure of the wire to humidity and/or other environmental contaminants. The tray 10 is designed to store the spool 14 without a box, so that the wire can be quickly inspected and possibly tagged with inventory control information. Such inspection and tagging may require the spool 14 to be removed from the tray 10 and the pouch or bag opened and resealed. However, the person inspecting the wire will not have to open and handle a cardboard shipping box, and will not have to handle stretch wrapping or strapping or de-palletize/re-palletize the spools, as discussed further below.

The tray 10 can be formed from any suitable material, such as a plastic, metal, etc. However, it can be desirable to form the tray 10 from a resilient, elastomeric material (e.g., rubber, thermoplastic elastomer, etc.) to provide a degree of cushioning for the spool 14 and wire.

The tray 10 is designed to support the spool 14 mechanically, by gravity. The tray 10 includes a bottom shelf 16 onto which the spool 14 is placed. The tray 10 can be U-shaped having a U-shaped bottom shelf 16 as shown, or the tray can be semicircular, or have other shapes to adequately hold a spool of wire. The tray 10 includes a raised, U-shaped sidewall 18. The U-shaped sidewall 18 extends upward from the edge of the U-shaped bottom shelf 16. The U-shaped sidewall 18 limits the lateral movement of the spool 14 within the tray 10. The sidewall 18 can have a curved portion having a radius to closely fit the curve of the spool of wire. For example, the radius of the curved portion of the U-shaped sidewall 18 can be slightly larger than the radius of the spool 14. Extending forward from the curved portion of the tray 10 are straight portions, giving the tray its U-shape. The sidewall 18 can closely surround at least 50% of the perimeter of the spool 14. The tray 10 has an open front portion from which the sidewall 18 is omitted, to facilitate placement of the spool 14 in the tray and removal of the spool from the tray. The U-shaped bottom shelf 16 and the U-shaped sidewall 18 form the open front portion of the storage tray, extending between the terminal ends of the U-shaped sidewall. The bottom shelf 16 of the tray 10 can be U-shaped as shown, so as to include an open central portion 20 that extends inward from the open front portion of the tray toward the center of the bottom shelf surface. The open central portion 20 and the U-shaped bottom shelf 16 can allow access to a lower spool flange located in the tray. Such access to the lower spool flange can facilitate placement of the spool 14 into the tray 10 and removal of the spool from the tray. For example, the open central portion 20 in the bottom shelf 16 can provide hand/arm access to the lower spool flange, so that a person can lift the spool 14 off of the tray 10 through the open central portion 20, and pull the spool through the open front portion of the tray.

The tray 10 is shown as an open cup configuration lacking an upper ceiling surface to form a pocket for the spool 14. In other example embodiments, the tray 10 includes an upper surface that projects inward from sidewall and over the spool 14, to limit the upward movement of the spool within the tray. Such an upper surface can be a U-shaped strip that projects slightly inward from the sidewall 18, or it can extend from sidewall-to-sidewall to cover substantially the entire top surface of the spool 14 or some portion of the upper spool flange.

Atop the U-shaped sidewall 18 is an outwardly projecting lip 22. The tray 10 further includes a plurality of mounting tabs 24. The mounting tabs 24 are shown as extending outward from the lip 22, but the mounting tabs could also extend directly from the sidewall 18. The mounting tabs 24 allow the tray 10 to be mounted in a frame or rack. The frame or rack would have openings, and the mounting tabs 24 would engage the openings to fix the position of the tray 10 within the frame/rack. The lip 22 can further include openings or mounting tab recesses 26 adjacent the mounting tabs 24. It can be seen that the frontward/rearward placement of the mounting tab 24 and mounting tab recess 26 on opposite lateral sides of the tray 10 are reversed (e.g., on one side the mounting tab is located just behind the mounting tab recess, and on the opposite side the mounting tab is located just in front of the mounting tab recess). For example, a first mounting tab (right side in FIG. 2) is located between a first terminal end of the U-shaped sidewall 18 and a first mounting tab recess. Across the tray 10 from the first mounting tab and first mounting tab recess is a second mounting tab and a second mounting tab recess (left side of FIG. 2). The second mounting tab recess is located between a second terminal end of the U-shaped sidewall and the second mounting tab. By reversing the placement of the mounting tab 24 and mounting tab recess 26 on opposite sides of the tray, two trays 10 can be placed next to each other closely within the frame/rack, and the mounting tab 24 on one tray can project into the mounting tab recess 26 on the neighboring tray next to it.

In certain embodiments, the tray 10 can include a plurality of vertical buttresses 28 spaced around the U-shaped sidewall 18, to strengthen the sidewall against deformation due to outward thrusts imparted on the sidewall by the spool of wire (e.g., during shipping when the spool is subject to side-to-side movement within the tray). The buttresses 28 can be molded with the tray 10 so as to be integral with the tray, and can be located beneath the lip 22 of the tray.

FIGS. 3-6 show an example embodiment of the tray 10 having resilient spool retaining bulges 29 to help prevent the spool from sliding forward through the open front portion of the tray. The resilient spool retaining bulges 29 are rounded inward projections located along the U-shaped sidewall 18. The resilient spool retaining bulges 29 can be integrally formed with the U-shaped sidewall 18 or otherwise attached to the sidewall. The resilient spool retaining bulges 29 can deflect outward when contacted by the spool 14 as it is inserted. When the maximum diameter of the spool 14 has passed rearward of the resilient spool retaining bulges 29, the bulges return to their original position to help prevent the spool from sliding forward during shipping. In certain embodiments, the tray 10 includes two resilient spool retaining bulges 29 located on opposite sides of the U-shaped sidewall 18, adjacent the mounting tabs 24 and mounting tab recesses 26 and near the terminal ends of the U-shaped sidewall.

The U-shaped bottom shelf 16 of the tray 10 can include curved openings 31 located just in front of the resilient spool retaining bulges 29 that extend for the length of the bulges. The curved openings 31 separate the resilient spool retaining bulges 29 from the bottom shelf 16, which allows the retaining bulges to deflect outward more freely as the spool 14 is inserted.

In certain embodiments, the resilient spool retaining bulges 29 engage the lower flange of the spool 14, but not the top flange, although the retaining bulges could engage both flanges if desired. The resilient spool retaining bulges 29 can have a slightly conical shape or upward taper, so that the lower portions of the bulges project inward into the tray 10 to a greater extent than the upper portions of the bulges. Alternatively, the resilient spool retaining bulges 29 could have no taper so that the upper portions of the bulges project inward to the same degree as the lower portions. Other configurations of resilient retaining bulges or projections will be apparent to those of ordinary skill in the art.

Figure 7:
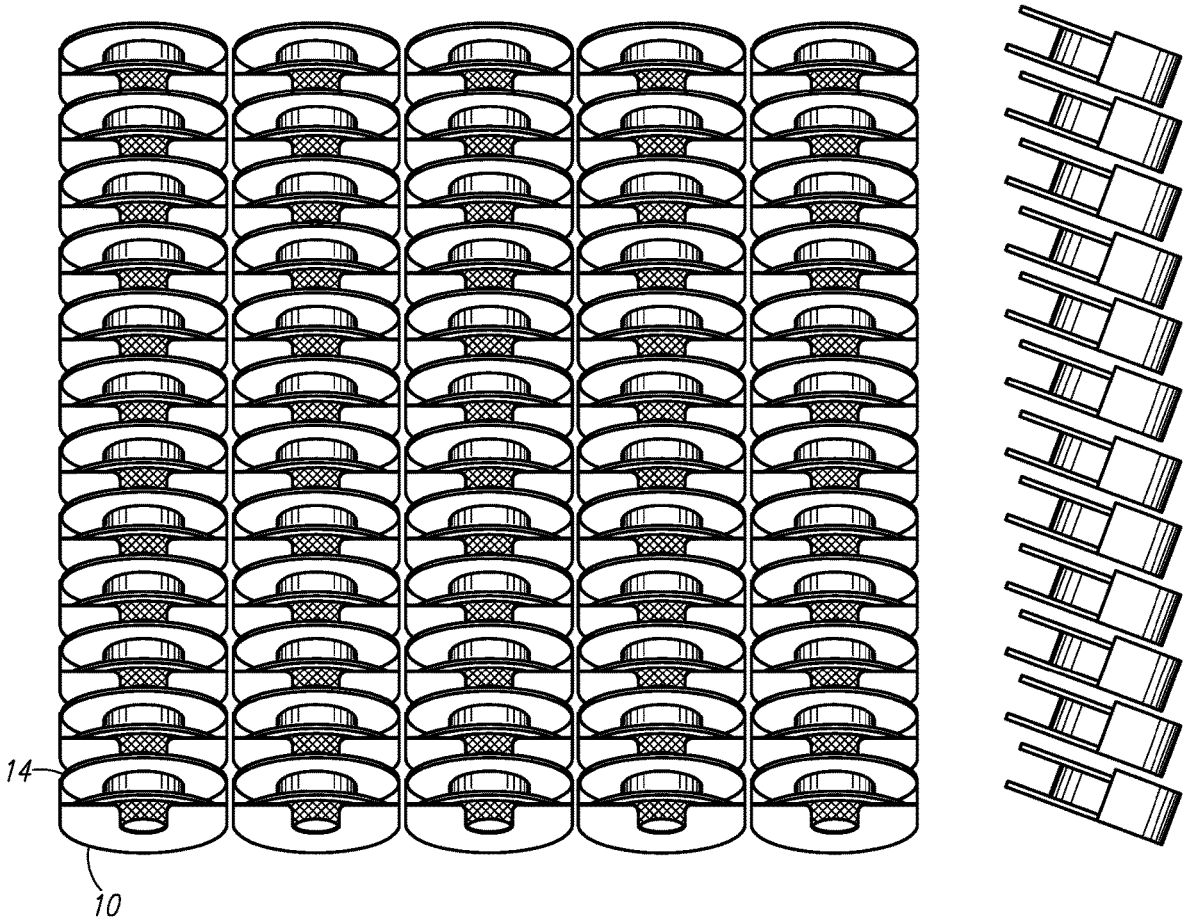
FIG. 7 shows an array of storage trays.

FIG. 7 shows an array of trays 10 for storing spools 14. Although the trays could be mounted horizontally or flat, it can be beneficial to incline the trays for gravity retention of the spools. The trays 10 are inclined from back to front, so that the open front portion of the tray is higher than the curved rear portion. From front to back, the trays are declined from the open front portion rearward. FIG. 7 shows the trays inclined/declined at less than 45° from horizontal, however other angles are possible. In a declined tray as shown, gravity will help to hold the spool 14 in the tray 10, and the spool is unlikely to fall out of the tray during shipping when subject to sudden accelerations and decelerations.

Figure 8:
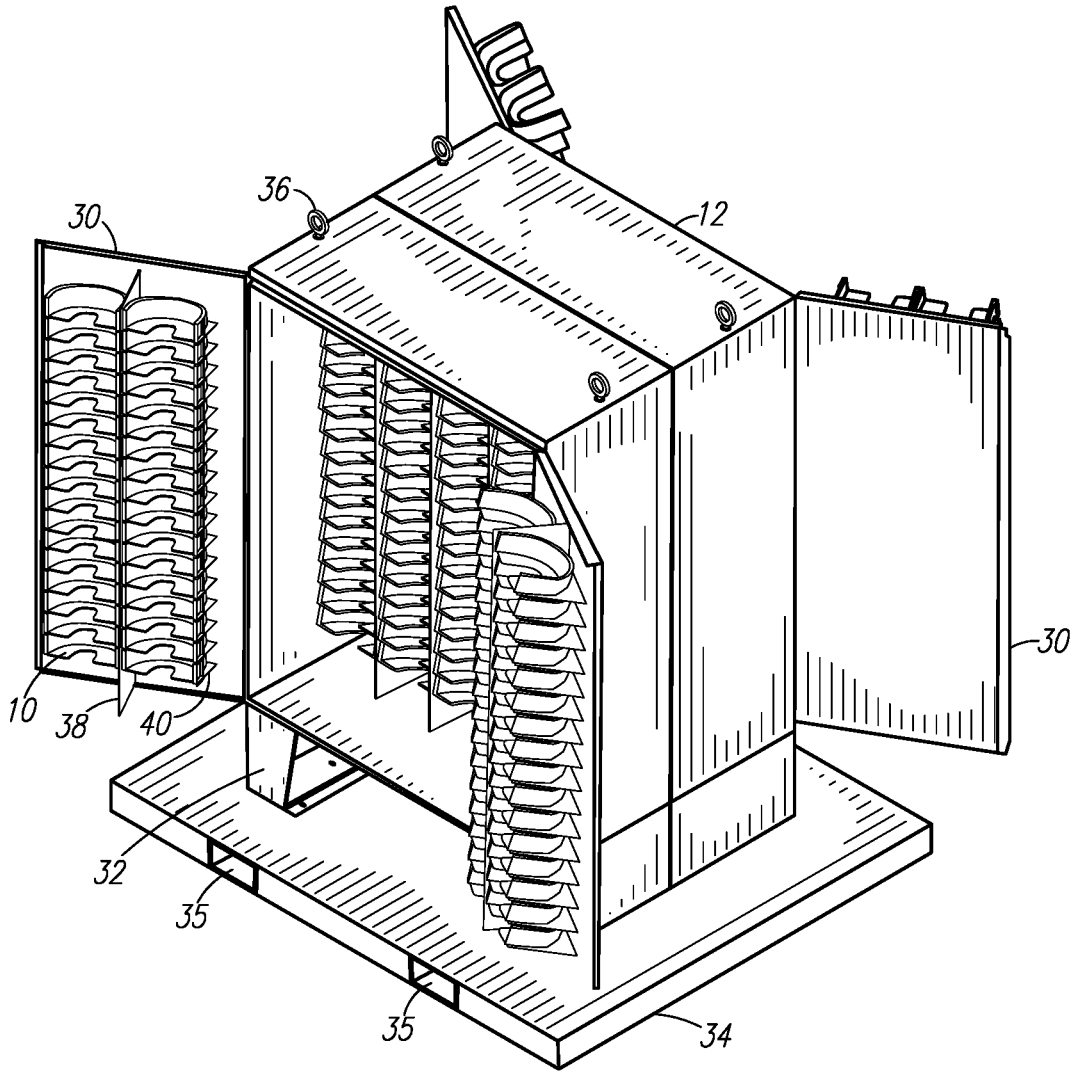
FIG. 8 is a perspective view a cabinet including the storage trays.

FIG. 8 is a perspective view a cabinet 12 including the storage trays 10 discussed above, and FIG. 9 is a front view of the cabinet. The cabinet 12 can be made of metal, such as coated steel (e.g., powder coated), stainless steel, aluminum, etc. The cabinet 12 can be designed to protect the spools of wire from dust and dripping or splashed water, sprayed water, and/or corrosive chemicals. Example enclosure styles for the cabinet 12 include so-called NEMA Type 12, Type 4, Type 4X and other types or styles of enclosure.

The cabinet 12 includes one or more doors 30 for providing access to the interior of the cabinet body. In FIG. 8, the doors 30 are French door style. The doors 30 or cabinet body can include a gasket around the perimeter of the opening in the cabinet body, for sealing the doors against the cabinet body.

The cabinet 12 includes floor stands 32 that are attached to the cabinet body. To facilitate movement of the cabinet 12 using a forklift, the floor stands 32 can be mounted to a base located beneath the cabinet body, to support the cabinet body above the base. An example base for the cabinet 12 is a pallet 34. For strength and durability, the pallet 34 can be metallic, such as steel, rather than wooden. The floor stands 32 can be bolted or welded to the pallet 34, or secured in another suitable manner. The pallet 34 can include openings or fork channels 35 that are configured to receive the forks of a forklift. In certain embodiments, the cabinet 12 can include lifting eyes 36, to allow the cabinet to be moved using a crane.

One or more cabinets 12 can be mounted to the pallet 34. In FIG. 8, two cabinets are mounted back-to-back on a single pallet 34. Alternatively, a single cabinet having access doors on both sides (front and back) of the cabinet can be used.

The cabinet 12 includes the trays 10 discussed above, mounted in the interior of the cabinet, and also on the interior surface of the doors 30. The trays 10 are mounted in vertical columns within a frame or rack system on the doors 30 and inside of the cabinet 12. The frame or rack system can include vertical members 38 having apertures for receiving the mounting tabs on the trays 10. The frame or rack system can also include horizontal supports 40 that support the weight of the tray and spool. In an example embodiment, the horizontal supports 40 are in the form of declined shelves that are oriented horizontally, but at a front-to-back decline, with the front edge of the shelves being higher than the rear edge of the shelves. Such shelves will support the trays from below at the proper declined angle. The horizontal supports 40 can have U-shaped openings or cut-outs corresponding to the open central portion 20 (FIG. 2) in the tray 10. Alternatively, the horizontal supports can be located only beneath a rear portion of the tray 10, inward of the open central portion 20 (FIG. 2) in the tray 10.

Figure 6:
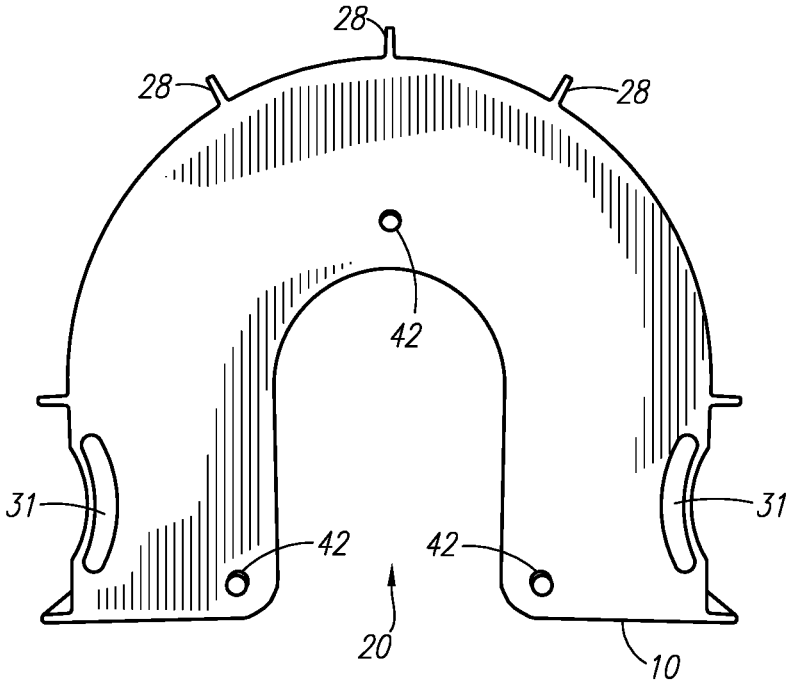
FIG. 6 is a bottom view of a storage tray.

As shown in FIG. 1 and FIG. 6, the tray 10 can include one or more alignment projections 42, such as pins or tabs, that project downward from the lower surface of the U-shaped bottom shelf 16 of the tray. The alignment projections 42 engage openings in the horizontal supports 40 to properly position the tray 10 on the horizontal support and restrict its lateral movement within the frame/rack. The alignment projections 42 can further serve to lock the trays 10 against the horizontal supports 40. For example, the alignment projections 42 can include a bulge or flange that is pressed through the corresponding opening in the horizontal supports as the tray is placed onto the support 40. Once pressed through the opening in the horizontal support 40, the bulge or flange on the alignment projection 42 expands beneath the horizontal support to resist upward movement of the installed tray 10.

Figure 10:
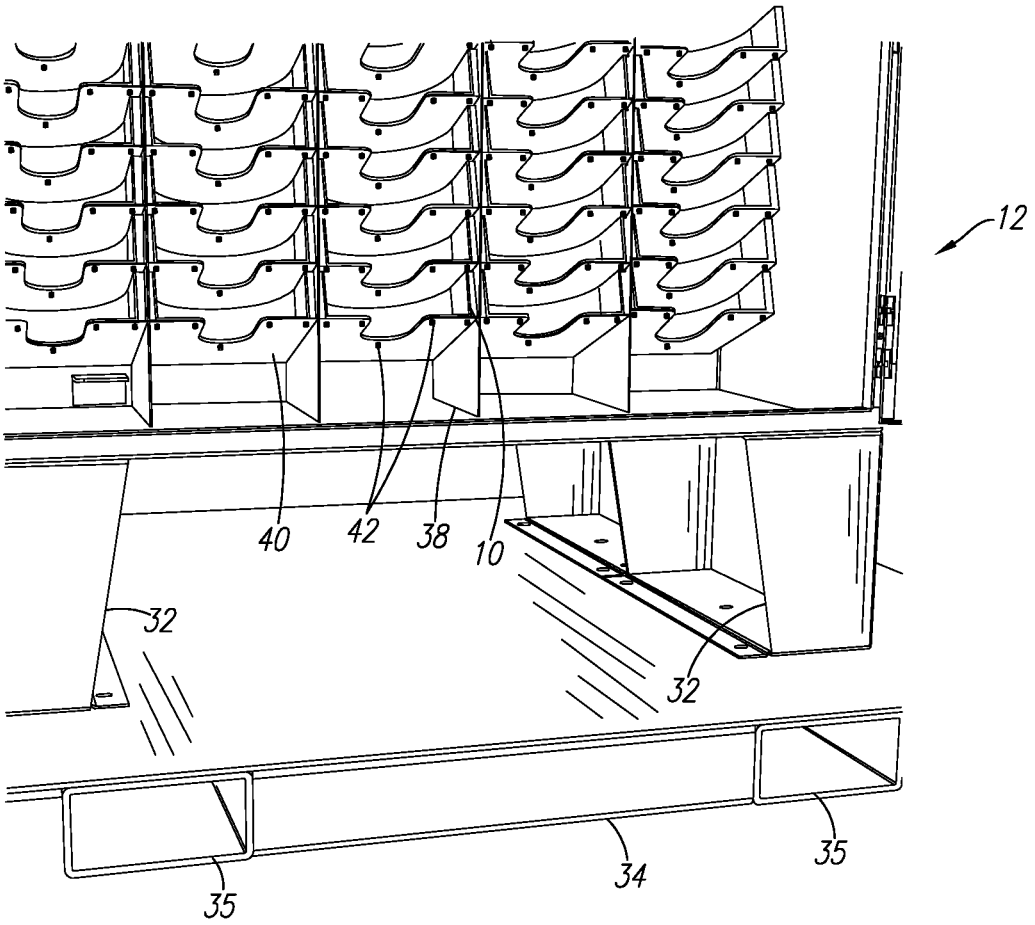
FIG. 10 is a perspective view of a portion of the cabinet.

FIG. 10 provides a closer view of an example frame or rack system in the cabinet 12. The horizontal supports 40 can be configured as long shelves that are supported by each of the vertical members 38. Alternatively, there can be one horizontal support 40 for each tray 10. The horizontal supports 40 can be connected to the vertical members 38 in various ways. For example, the horizontal supports 40 and vertical members 38 can have corresponding slots so that the horizontal supports fit into the vertical members at the correct declining angle. Alternatively, the horizontal supports 40 can be bolted, welded, etc. to the vertical members 38 at the correct declining angle. The alignment projections 42 of the trays 10 that pass through the horizontal supports 40 can be seen in FIG. 10.

Figure 11:
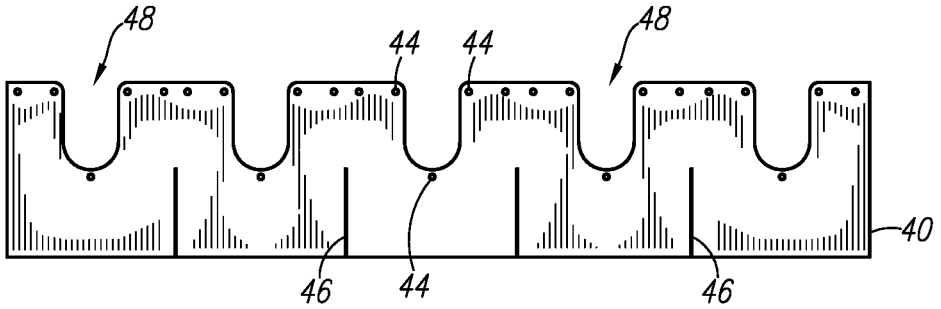
FIG. 11 shows a horizontal support located within the cabinet.

FIG. 11 shows an example horizontal support 40 configured to hold five separate spool trays. The horizontal support 40 has a plurality of openings 44 for receiving the alignment projections on the trays. The horizontal support 40 can further have a plurality of slots 46 that fit into corresponding angled slots on the vertical members of the frame or rack system. As discussed above, the horizontal supports 40 can have U-shaped openings 48 or cut-outs corresponding to the open portions of the spool trays. The U-shaped openings 48 facilitate the placement and removal of the spools of wire by providing access to the lower surface of the spool and hand/arm access so that a person can lift the spool off of a tray.

Figure 9:
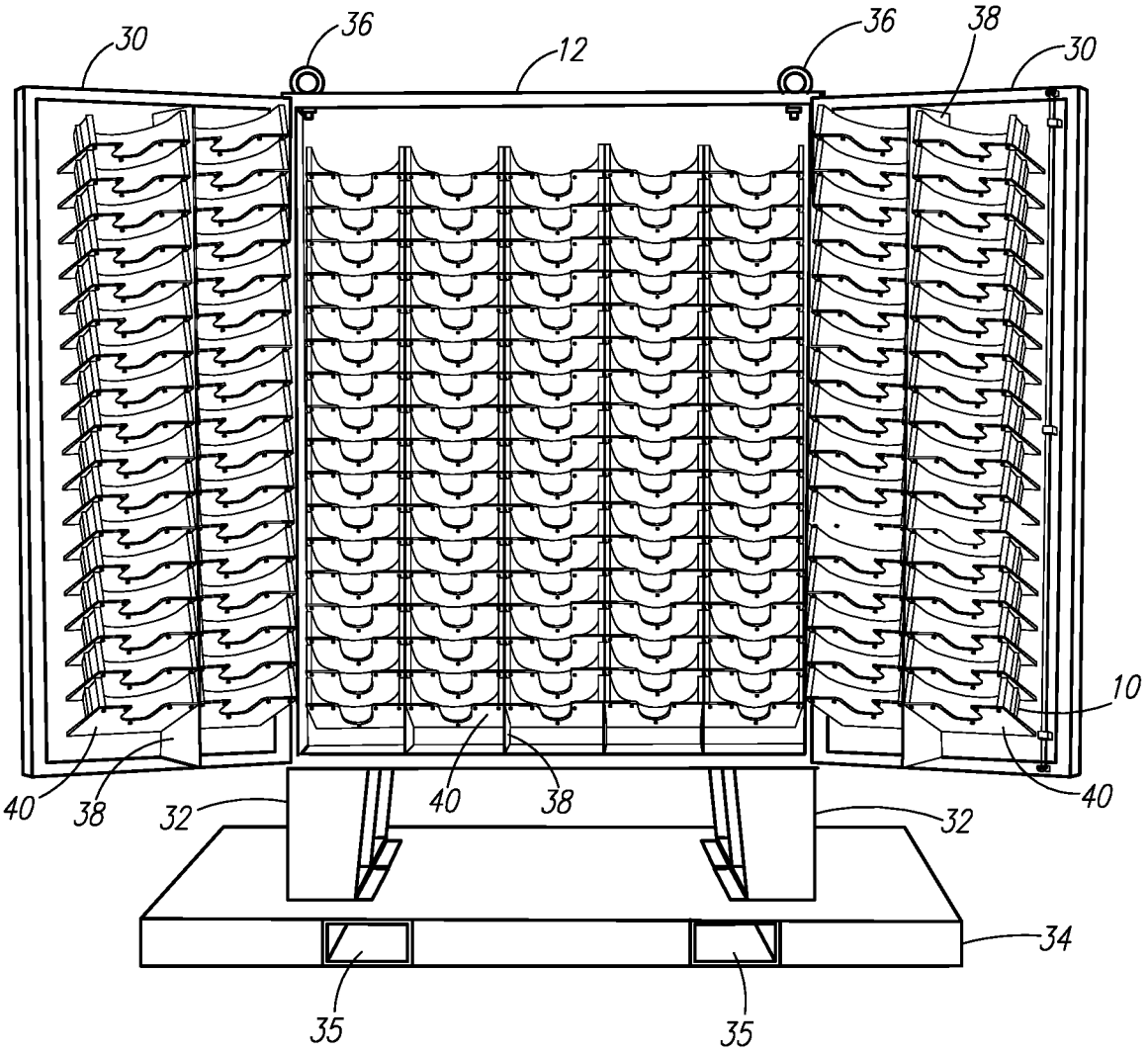
FIG. 9 is a front view the cabinet including the storage trays.

With reference to FIGS. 8-10, a supplier of spooled wire, such as welding wire, can fill the trays 10 in the cabinet 12 with spooled wire for shipping to a customer. The spooled wire can be sealed in a pouch or bag, shrink wrapped, capsule sealed, or stored without additional packaging. The cabinet 12 will function as a shipping container and a storage cabinet. Upon arrival at a customer's facility, the spooled wire can be inspected and tagged with inventory control information (e.g., a barcode, RFID tag, serial number, and the like), and then further stored in the cabinet 12 until needed. The shipping and storage system discussed herein eliminates much of the disposable packaging involved in the shipping of boxed and palletized spooled wire, and most of the packaging that is used is reusable over and over again. Inventory handling or intake time at the customer's facility can be reduced because the spooled wire does not have to be de-palletized or re-palletized, unboxed, and stored elsewhere. The cabinet 12 and spooled wire are merely moved to a desired storage location within the customer's facility, using a forklift or crane for example.

As the spooled wire is used by the customer, the empty spools can be stored in the cabinet 12 for recycling or reuse. When empty of spooled wire, the cabinet 12 and attached pallet, and optionally the empty spools, can be returned to the supplier of spooled wire for reuse by the supplier. The empty spools can be reused by the supplier or recycled. A deposit can be paid to the customer by the supplier upon return of the cabinet 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A spooled wire storage tray, comprising:
a U-shaped bottom shelf;
a U-shaped sidewall extending upward from the U-shaped bottom shelf;
a lip atop the U-shaped sidewall;
a first resilient spool retaining bulge located along the U-shaped sidewall; and
a second resilient spool retaining bulge located along the U-shaped sidewall opposite the first resilient spool retaining bulge,
wherein the U-shaped bottom shelf and the U-shaped sidewall form an open front portion of the storage tray extending between terminal ends of the U-shaped sidewall, and
wherein the U-shaped bottom shelf forms an open central portion of the storage tray that extends inward from the open front portion of the storage tray, allowing access to a lower spool flange through the U-shaped bottom shelf.

2. The spooled wire storage tray of claim 1, wherein the U-shaped bottom shelf includes respective openings that separate the first resilient spool retaining bulge and the second resilient spool retaining bulge from the U-shaped bottom shelf.

3. The spooled wire storage tray of claim 1, wherein the first resilient spool retaining bulge and the second resilient spool retaining bulge are tapered, with respective lower portions of the first resilient spool retaining bulge and the second resilient spool retaining bulge projecting inward into the spooled wire storage tray to a greater extent than respective upper portions of the first resilient spool retaining bulge and the second resilient spool retaining bulge.

4. The spooled wire storage tray of claim 1, further comprising a plurality of alignment pins that project downward from the U-shaped bottom shelf.

5. The spooled wire storage tray of claim 1, further comprising a plurality of buttresses located on the U-shaped sidewall.

6. The spooled wire storage tray of claim 5, wherein the plurality of buttresses are located beneath the lip.

7. The spooled wire storage tray of claim 1, further comprising a plurality of mounting tabs extending from at least one of the U-shaped sidewall and the lip.

8. The spooled wire storage tray of claim 1, further comprising:
a first mounting tab and a first mounting tab recess located along the lip adjacent the first resilient spool retaining bulge;
a second mounting tab and a second mounting tab recess located along the lip adjacent the second resilient spool retaining bulge,
wherein the first mounting tab is located between a first terminal end of the U-shaped sidewall and the first mounting tab recess, and
wherein the second mounting tab recess is located between a second terminal end of the U-shaped sidewall and the second mounting tab.

9. A spooled wire storage tray, comprising:
a U-shaped bottom shelf;
a U-shaped sidewall extending upward from the U-shaped bottom shelf;
a lip atop the U-shaped sidewall;
a plurality of buttresses located on the U-shaped sidewall; and
a plurality of mounting tabs extending from at least one of the U-shaped sidewall and the lip;
wherein the U-shaped bottom shelf and the U-shaped sidewall form an open front portion of the storage tray extending between terminal ends of the U-shaped sidewall, and
wherein the U-shaped bottom shelf forms an open central portion of the storage tray that extends inward from the open front portion of the storage tray, allowing access to a lower spool flange through the U-shaped bottom shelf.

10. The spooled wire storage tray of claim 9, wherein the plurality of buttresses are located beneath the lip.

11. The spooled wire storage tray of claim 10, wherein the plurality of mounting tabs include:
a first mounting tab and a first mounting tab recess located along the lip;

a second mounting tab and a second mounting tab recess located along the lip across from the first mounting tab and the first mounting tab recess, wherein the first mounting tab is located between a first terminal end of the U-shaped sidewall and the first mounting tab recess, and wherein the second mounting tab recess is located between a second terminal end of the U-shaped sidewall and the second mounting tab.

12. The spooled wire storage tray of claim 11, further comprising a plurality of alignment pins that project downward from the U-shaped bottom shelf.

13. The spooled wire storage tray of claim 9, further comprising:

a first resilient spool retaining bulge located along the U-shaped sidewall; and a second resilient spool retaining bulge located along the U-shaped sidewall opposite the first resilient spool retaining bulge.

14. The spooled wire storage tray of claim 13, wherein the U-shaped bottom shelf includes respective openings that separate the first resilient spool retaining bulge and the second resilient spool retaining bulge from the U-shaped bottom shelf.

15. The spooled wire storage tray of claim 14, wherein the first resilient spool retaining bulge and the second resilient spool retaining bulge are tapered, with respective lower portions of the first resilient spool retaining bulge and the second resilient spool retaining bulge projecting inward into the spooled wire storage tray to a greater extent than respective upper portions of the first resilient spool retaining bulge and the second resilient spool retaining bulge.

16. A spooled wire storage device, comprising:

a cabinet body;

a door for providing access to an interior of the cabinet body;

a plurality of U-shaped spooled wire storage trays mounted within the cabinet body, wherein the U-shaped spooled wire storage trays each include a U-shaped bottom shelf, and a U-shaped sidewall extending upward from the U-shaped bottom shelf, wherein the U-shaped bottom shelf and the U-shaped sidewall form an open front portion of the storage tray extending between terminal ends of the U-shaped sidewall, and wherein the U-shaped bottom shelf declines from the open front portion rearward;

a spool of wire located in each of the plurality of U-shaped spooled wire storage trays; and a base located beneath the cabinet body, wherein the base forms a first fork channel and a second fork channel configured to receive forklift forks.

17. The spooled wire storage device of claim 16, further comprising a floor stand supporting the cabinet body above the base.

18. The spooled wire storage device of claim 16, further comprising a plurality of declined horizontal supports having U-shaped openings, wherein the U-shaped openings are respectively aligned with the plurality of U-shaped spooled wire storage trays.

19. The spooled wire storage device of claim 16, wherein each of the plurality of U-shaped spooled wire storage trays comprises:

a lip atop the U-shaped sidewall;

a first resilient spool retaining bulge located along the U-shaped sidewall; and a second resilient spool retaining bulge located along the U-shaped sidewall opposite the first resilient spool retaining bulge, and wherein the U-shaped bottom shelf forms an open central portion of the storage tray that extends inward from the open front portion of the storage tray, allowing access to a lower spool flange through the U-shaped bottom shelf.

20. The spooled wire storage device of claim 16, wherein each of the plurality of U-shaped spooled wire storage trays comprises:

a lip atop the U-shaped sidewall;

a first resilient spool retaining bulge located along the U-shaped sidewall; and a second resilient spool retaining bulge located along the U-shaped sidewall opposite the first resilient spool retaining bulge;

a plurality of buttresses located on the U-shaped sidewall beneath the lip;

a plurality of alignment pins that project downward from the U-shaped bottom shelf;

a first mounting tab and a first mounting tab recess located along the lip adjacent the first resilient spool retaining bulge;

a second mounting tab and a second mounting tab recess located along the lip adjacent the second resilient spool retaining bulge, wherein the first mounting tab is located between a first terminal end of the U-shaped sidewall and the first mounting tab recess, wherein the second mounting tab recess is located between a second terminal end of the U-shaped sidewall and the second mounting tab, wherein the U-shaped bottom shelf forms an open central portion of the storage tray that extends inward from the open front portion of the storage tray, allowing access to a lower spool flange through the U-shaped bottom shelf, wherein the U-shaped bottom shelf includes respective openings that separate the first resilient spool retaining bulge and the second resilient spool retaining bulge from the U-shaped bottom shelf, and wherein the first resilient spool retaining bulge and the second resilient spool retaining bulge are tapered, with respective lower portions of the first resilient spool retaining bulge and the second resilient spool retaining bulge projecting inward into the spooled wire storage tray to a greater extent than respective upper portions of the first resilient spool retaining bulge and the second resilient spool retaining bulge.

* * * * *